US012050072B2

(12) United States Patent
Seidl

(10) Patent No.: US 12,050,072 B2
(45) Date of Patent: Jul. 30, 2024

(54) TRIGGER MECHANISM OF A HANDGUN

(71) Applicant: Blaser Group GmbH, Isny (DE)

(72) Inventor: Paul Seidl, Argenbühl (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 18/106,042

(22) Filed: Feb. 6, 2023

(65) Prior Publication Data

US 2023/0375296 A1 Nov. 23, 2023

(30) Foreign Application Priority Data

Feb. 7, 2022 (DE) ..... 10 2022 102 809.7

(51) Int. Cl.
*F41A 17/46* (2006.01)

(52) U.S. Cl.
CPC ..... *F41A 17/46* (2013.01)

(58) Field of Classification Search
CPC ..... F41A 17/46
See application file for complete search history.

(56) References Cited

U.S. PATENT DOCUMENTS

| | | | | |
|---|---|---|---|---|
| 4,471,551 | A | 9/1984 | Mattarelli | |
| 5,465,518 | A | 11/1995 | Blaser | |
| 6,813,854 | B2 | 11/2004 | Popikow | |
| 7,165,350 | B2 | 1/2007 | Popikow | |
| 8,656,620 | B2 | 2/2014 | Hankel | |
| 8,677,666 | B2 | 3/2014 | Pichler | |
| 10,809,031 | B2 * | 10/2020 | Geissele | F41A 19/43 |
| 2001/0016997 | A1 | 8/2001 | Zeh | |
| 2005/0188577 | A1 | 9/2005 | Popikow | |
| 2023/0251052 | A1 | 8/2023 | Seidl | |
| 2023/0400273 | A1 | 12/2023 | Seidl | |

FOREIGN PATENT DOCUMENTS

| | | | |
|---|---|---|---|
| AT | 507 904 | A4 | 9/2010 |
| DE | 3740940 | A1 | 2/1989 |
| DE | 44 13 685 | A1 | 10/1994 |
| DE | 198 10 787 | A1 | 9/1999 |
| DE | 102 35 282 | A1 | 2/2004 |

(Continued)

OTHER PUBLICATIONS

Office Action dated Jan. 8, 2024 for U.S. Appl. No. 18/105,925.

(Continued)

*Primary Examiner* — Reginald S Tillman, Jr.
(74) *Attorney, Agent, or Firm* — Paul D. Bianco; Katharine Davis Wong; Fleit Intellectual Property Law

(57) ABSTRACT

A trigger mechanism of a firearm includes a trigger movable between an initial position and a discharge position, a sear movable between a holding position and a half-cocked position, and a transfer element movable by actuation of the trigger between a holding position for holding the sear in the cocked position and a release position for moving the sear into the half-cocked position. A safety device is assigned to the trigger with two pendulums pivotable about a transverse axis and deflectable by impacts. The two pendulums are connected to the trigger in such a way that the trigger is forced into its initial position by at least one of the two pendulums during deflection of the two pendulums caused by impact.

9 Claims, 7 Drawing Sheets

(56) References Cited

FOREIGN PATENT DOCUMENTS

| | | | |
|---|---|---|---|
| DE | 10 2004 041 054 | B3 | 3/2006 |
| DE | 20 2011 002 579 | U1 | 5/2012 |
| DE | 10 2014 102 774 | B3 | 12/2014 |
| DE | 20 2015 101 485 | U1 | 6/2016 |
| EP | 0072 851 | B1 | 1/1985 |
| EP | 0408798 | A1 | 1/1991 |
| FR | 2846737 | A1 | 5/2004 |
| FR | 3043767 | A1 | 5/2017 |
| FR | 3070483 | B1 | 9/2019 |
| RU | 2677165 | C1 | 1/2019 |
| WO | 2021/122443 | A1 | 6/2021 |

OTHER PUBLICATIONS

Search Report for German Application No. 10 2022 102 808.9, filed Feb. 7, 2022.
Result of Examination Report for German Patent Application No. 10 2022 102 809.7, filed Feb. 7, 2022.
Result of Examination Report for German Patent Application No. 10 2022 102 807.0, filed Feb. 7, 2022.

* cited by examiner

TRIGGER MECHANISM OF A HANDGUN

FIELD OF THE INVENTION

The invention relates to a trigger mechanism of a firearm.

BACKGROUND

A trigger mechanism of a firearm is known from DE 20 2015 101 485 U1 with a trigger housing, a trigger arranged to be pivotable in the trigger housing between an initial position and a discharge position, a sear arranged to be pivotable in the trigger housing between a holding position and a release position and cooperating with the trigger, and a breech catch element arranged to be displaceable on the trigger housing to limit the axial movement of the bolt during opening. The trigger mechanism also has an adjustment mechanism to change the trigger weight. The trigger mechanism, however, requires increased care during handling precisely at limited trigger weights.

SUMMARY

One aspect of the invention relates to a trigger mechanism which has improved safety against unintended discharge.

Accordingly, a trigger mechanism and expedient embodiments and advantageous further refinements are disclosed herein.

In the trigger mechanism according to the invention, a safety device with two pendulums pivotable by impacts is assigned to the trigger, which can be moved between an initial position and a discharge position, wherein the two pendulums are connected to the trigger in such a way that the trigger is forced by at least one of the two pendulums into its initial position during an excursion of the two pendulums caused by impact. The trigger mechanism therefore has an impact or drop safety that is effective in all directions, and by means of which unintended discharge in the event of impacts, shocks, or the like can be prevented. The force exerted on the trigger by the two pendulums during their excursion increases the force required to actuate the trigger. The higher the percussive forces acting on the trigger mechanism or small arm, the greater the increase in trigger resistance to prevent unintentional discharge. Thus, a further improvement in safety can be achieved.

In an expedient embodiment, the two pendulums arranged to pivot about a transverse axis in a trigger housing are designed as eccentrically mounted inertial bodies whose center of gravity is offset upward relative to the transverse axis and forward, as seen in the direction of firing.

The two pendulums can be arranged, in a favorably configured and space-saving design, to be rotatable about a common axis of rotation via a transverse bore and a transverse pin. However, the two pendulums can also have separate axes of rotation. The two pendulums have an identical basic shape, but can also be designed differently.

The one pendulum can have on its back end surface, as seen in the direction of firing, a first pressure element offset in a first direction relative to the transverse axis for contact against the trigger and a first spring for pressing the first pressure element against the trigger; and the second pendulum can have on its back end surface, as seen in the direction of firing, a second pressure element offset in a second direction opposite the first direction relative to the transfer axis and a second spring for pressing the second pressure element against the trigger.

The two pendulums can have on their back end surface an upper blind bore arranged above the axis of rotation and a lower blind bore arranged beneath the axis of rotation, in each of which a spring and a pressure element are arranged.

The two springs and the two pressure elements of the first and second pendulums expediently lie against an upwardly projecting part of a trigger blade carrier of the trigger rotatable about the transverse pin The pressure elements preferably consist of rubber or a similar elastic material. However, they can also consist of another material.

The transfer element arranged between the trigger and the sear can be designed in the form of a rotatable rocker with a first arm cooperating with the trigger and the second arm cooperating with the sear. A first stop is preferably arranged on the first arm of the transfer element to engage with a first counter stop on the trigger, and a second stop is arranged on the second arm of the transfer element to engage with a second counter stop on the sear.

BRIEF DESCRIPTION OF THE DRAWINGS

Further details and advantages of the invention are apparent from the following description of a preferred embodiment example with reference to the drawing. In the drawing.

DETAILED DESCRIPTION

Figure 1:
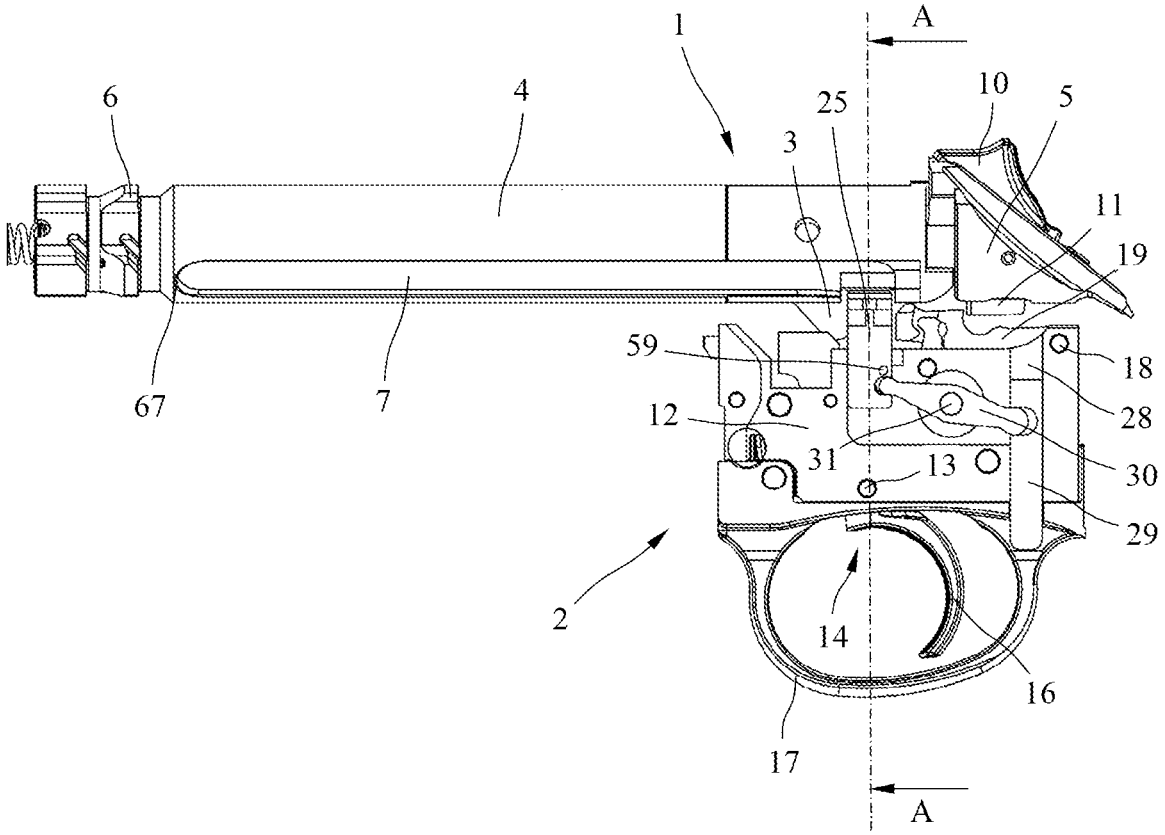
FIG. 1 shows a bolt and a trigger mechanism of a repeating weapon in a side view.

FIG. 1 shows a part of a repeating weapon that contains a chamber breech with an axially movable bolt 1 and a trigger mechanism 2. The bolt 1 contains a cylindrical bolt body 4 axially displaceable within a breech housing by means of a bolt handle 3 and rotatable about the center axis between a locked position and an unlocked position, and a small breech 5 arranged on its rear end. A plurality of locking lugs 6 are provided on the front end of the cylindrical bolt body 4 in known fashion to lock bolt 1 in the breech housing, a receiver sleeve or in a barrel. An axial guide groove 7 is arranged on the outside of the cylindrical bolt body 4.

Figure 2:
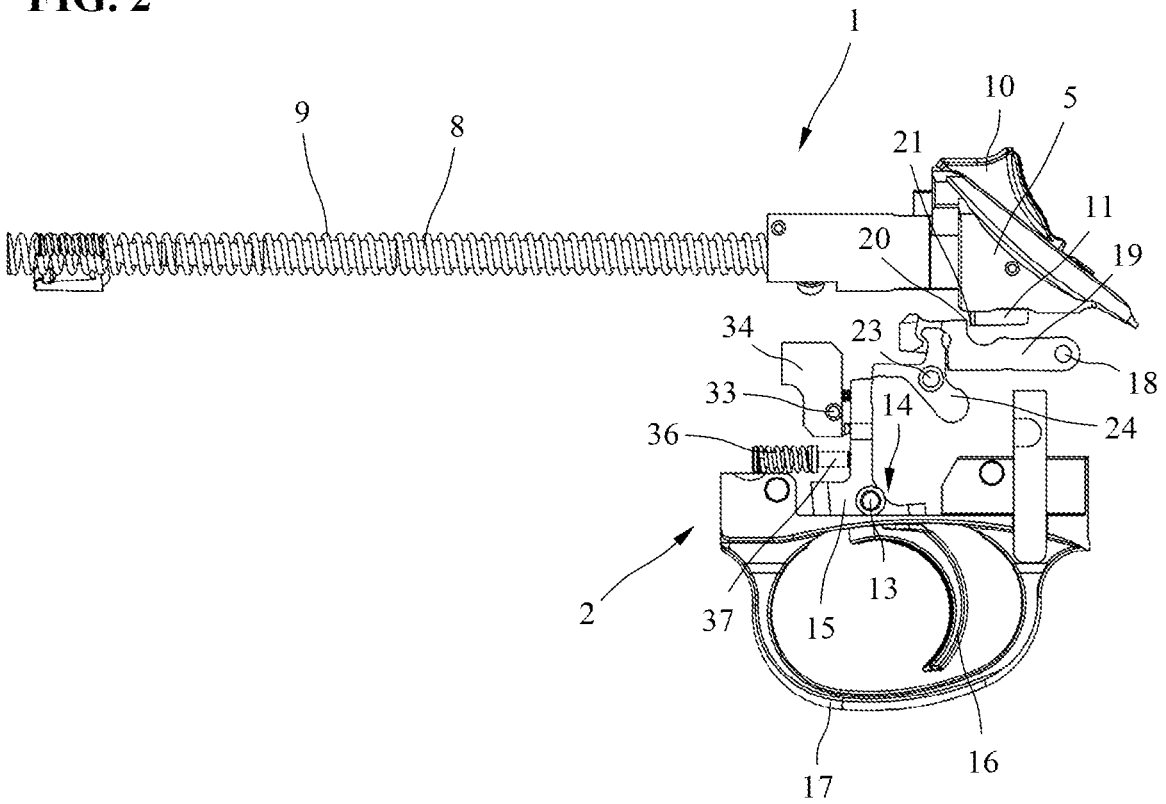
FIG. 2 shows the bolt and the trigger mechanism shown in FIG. 1 with partially blanked-out parts in a side view.

A firing pin 8 shown in FIG. 2 and a firing pin spring 9 arranged coaxially around the firing pin 8 are guided axially displaceably in the bolt body 4 and the breech 5 of bolt 1. A thumb-operated cocking slide 10 is arranged on the breech 5 of bolt 1 to cock the firing pin spring 9. A firing pin nut 11 guided to be displaced axially within breech 5 is fastened on the rear end of the firing pin 8.

Figure 3:
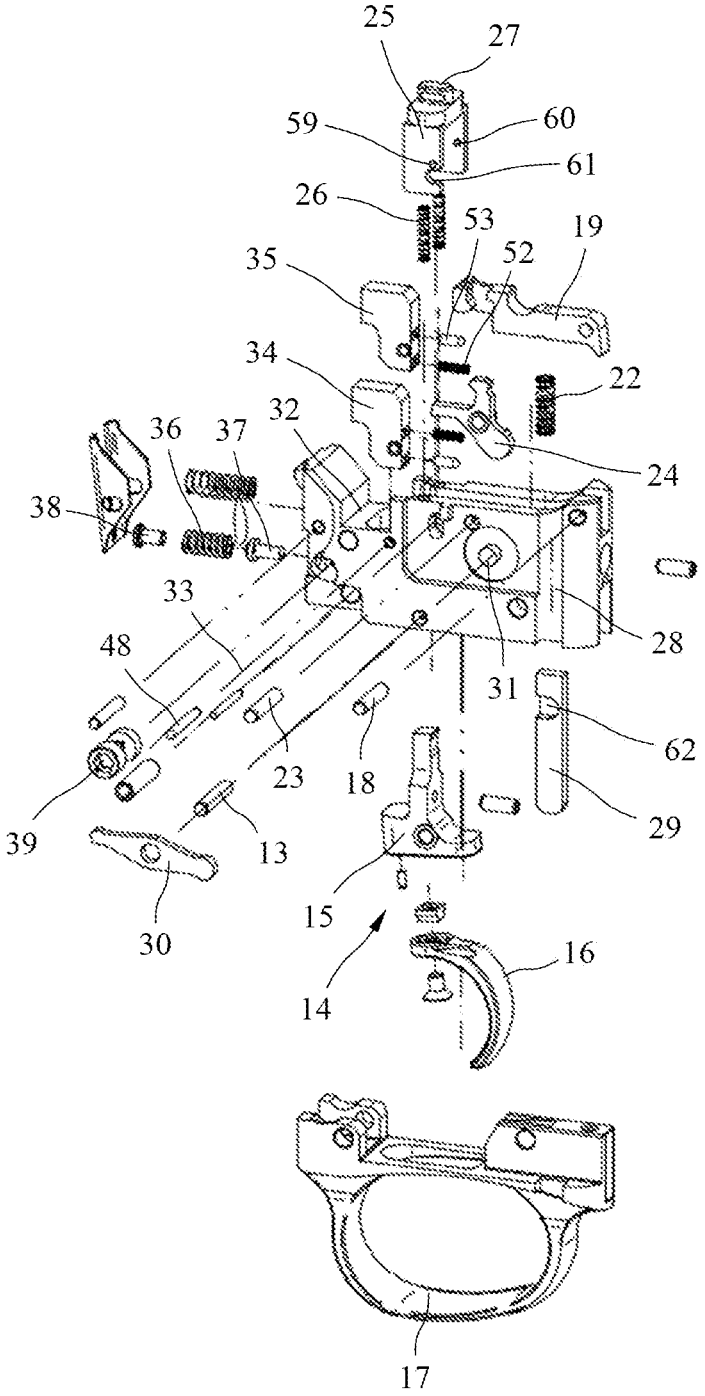
FIG. 3 shows the trigger mechanism shown in FIG. 1 of a repeating weapon in an exploded view.

The trigger mechanism 2 also shown in FIG. 3 in an exploded view contains a trigger 14 pivotable within a trigger housing 12 about a first transverse pin 13, which in the depicted embodiment example consists of a trigger blade carrier 15 rotatable about the first transverse pin 13 and a trigger latch 16 releasably fastened to the bottom of trigger blade carrier 15. A trigger guard 17 is fastened to the bottom of the trigger housing 12. The trigger mechanism 2 also contains a sear 19 pivotable in trigger housing 12 about a second transverse pin 18, which contains a sear stop 20, shown in FIG. 2, to engage with a stop edge 21 of the firing pin nut 11. The sear 19 is forced upward into a cocked position in the direction of firing pin nut 11 via a spring 22, shown in FIG. 3.

In order for the sear 19 to be moved by actuation of trigger 14 from its upper cocked position for holding of the firing pin nut 11 into a lower half-cocked position for release of the firing pin nut 11, a rocker-like transfer element 24 pivotable about a third transverse pin 23 is provided within trigger housing 12 between trigger 14 and sear 19. The rocker-like transfer element 24 is movable between a holding position to hold the sear 19 in the cocked position and a release position to move the sear 19 into the half-cocked position.

As shown in FIG. 1, a fork-like breech catch element 25 is arranged on the trigger housing 12 so as to be displaceable transversely to bolt 1. The breech catch element 25 is forced upward by compression springs 26 shown in FIG. 3 and has a pin 27 on its top to engage in the guide groove 7 on the outside of bolt body 4. Lowering of the breech catch element 25 also shown in FIG. 4 can occur through a control slide 29 guided to move in a guide groove 28 on the side of the trigger housing 12 via a lever 30 mounted to rotate on trigger housing 1. The lever 30 is designed as a double-arm lever that can be pivoted centrally about a pivot 31, so that the breech catch element 25 can be lowered by raising the control slide 29 for disassembly of bolt 1.

As can be seen from FIG. 3, two pendulums 34 and 35, pivotable about a transverse axis 33 by means of a transverse pin 48, are arranged in a recess 32 on the top of trigger housing 12. These pendulums 34 and 35 form a part of an impact or drop safety, which will be explained in more detail below.

The trigger 14 is movable between an initial position, shown in FIG. 2, and a retracted discharge position. The trigger 14 is pressed into the initial position via a pressure pin 37 by means of a trigger spring 36, shown in FIGS. 2 and 3. In the embodiment shown, the trigger spring 36, designed here as a helical compression spring, sits within a longitudinal bore running through the trigger housing 1 in the longitudinal direction thereof and is compressed between the pressure pin 37 and a spring pin 38, which bears against a bolt-shaped control element 39 arranged in trigger housing 12 for altering the trigger weight. A plurality of circumferentially distributed adjustment surfaces are provided on the bolt-shaped control element 39 for varying the bias of the trigger spring 36.

Figure 4:
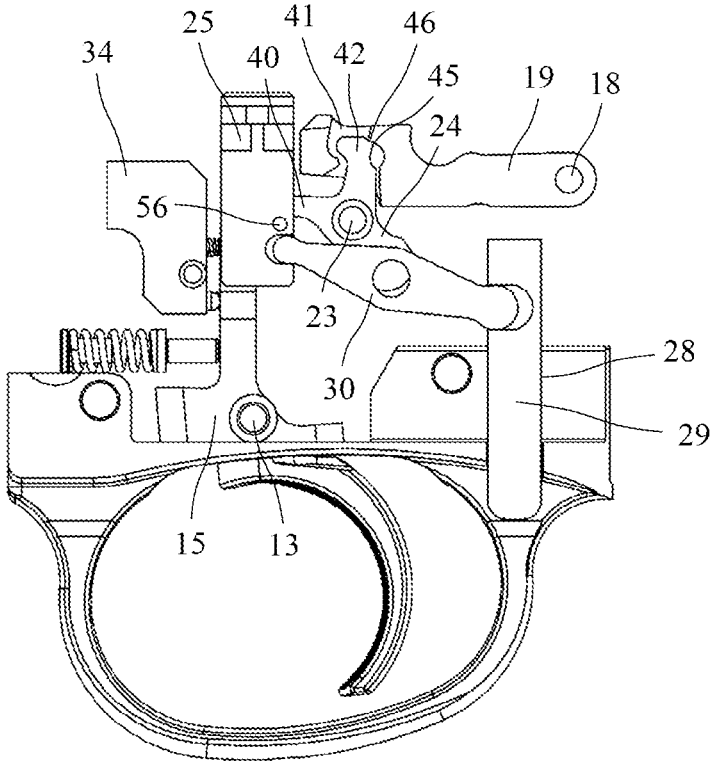
FIG. 4 shows a part of the trigger mechanism shown in FIG. 3 in a side view.
Figure 5:
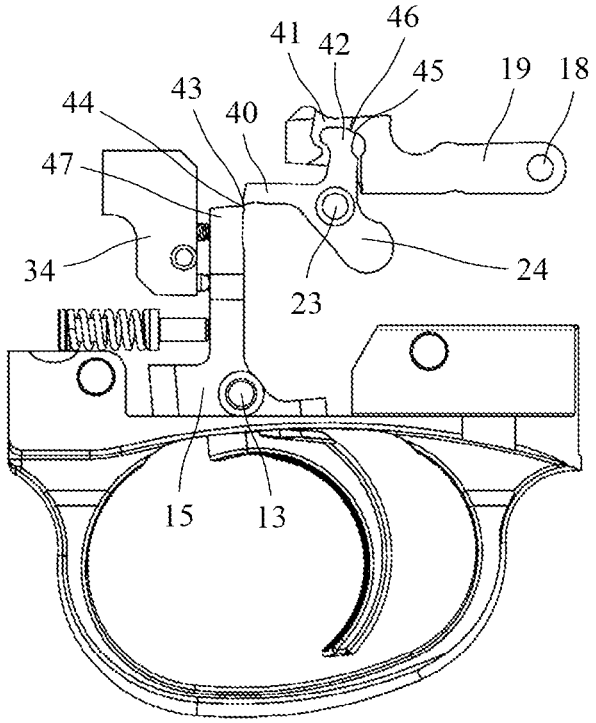
FIG. 5 shows the trigger mechanism shown in FIG. 4 with blanked-out components in a side view.
Figure 6:
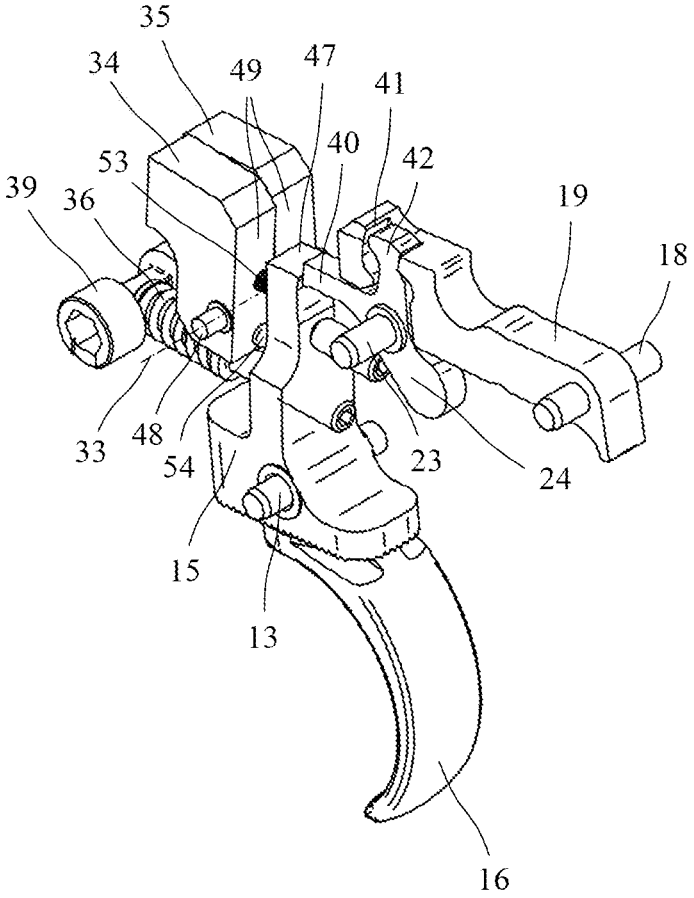
FIG. 6 shows a part of the trigger mechanism shown in FIG. 3 in a perspective view.

As shown in FIGS. 4 and 5, the rocker-like transfer element 24, rotatable about the third transverse pin 23, has a forward extending first arm 40, as seen in the direction of firing, and an upward extending second arm 42 engaging in a recess 41 of sear 19. A lower first stop 43 is provided on the front end of the forward extending first arm 40 to engage with a first counter stop 44 on trigger 14. The first counter stop 44 is arranged on an upwardly extending part 47 of the trigger blade carrier 15 pivotable about the transverse axis 13. An upper second stop 45 is provided on the upwardly extending second arm 42 of the rocker-like transfer element 24 rotatable about transverse axis 23 for engagement with a forward protruding second counter stop 46 in the recess 41 of sear 19. The second stop 45 on the second arm 42 of the transfer element 24 and the counter stop 46 in recess 41 of sear 19 are designed such that the sear 19, pivotable about transverse pin 18, can be moved downward into a half-cocked position by a counterclockwise rotation of the transfer element 24.

Figure 7:
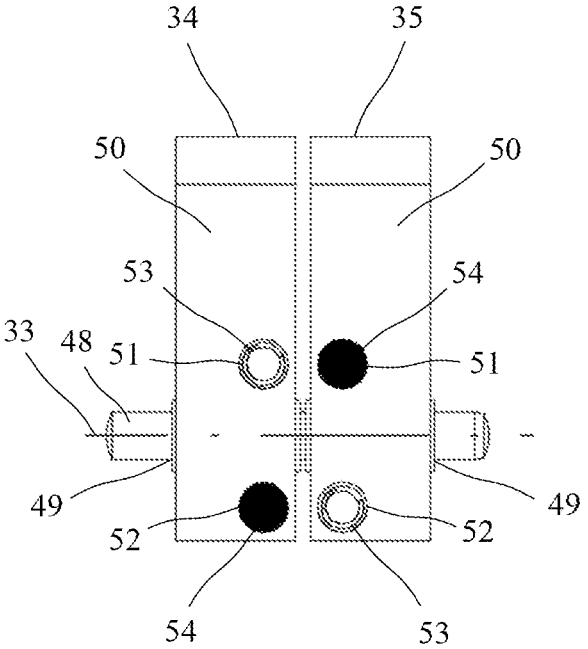
FIG. 7 shows a rear view of two pendulums of the trigger mechanism shown in FIG. 3.

The two pendulums 34 and 35, mounted to pivot in trigger housing 12 through a transverse pin 48 about pivot axis 33 and shown separately in a rear view in FIG. 7, each have a transverse bore 49 to accommodate transverse pin 48. The two angular pendulums 34 and 35 are designed as eccentrically mounted inertial bodies, so that their center of gravity is offset upward relative to transverse axis 33 and forward, as seen in the direction of firing. The pendulums 34 and 35 therefore execute a pivoting movement about transverse axis 33 during impacts on trigger housing 12. The pendulums 34 and 35 each contain on their rear end surfaces 50 facing the upper part 47 of trigger blade carrier 15, as seen in the direction of firing, an upper blind bore 51 arranged above the transverse bore 49 and a lower blind bore 52 arranged beneath the transverse bore 49. A first spring 53 is arranged in the upper blind bore 51 of the left pendulum 34 viewed in the direction of firing for contact against the upper part 47 of the trigger blade carrier 15 and a first pressure element 54 designed here pin-like is arranged in the lower blind bore 52 of the left pendulum 34, viewed in the direction of firing, for contact against the upper part 47 of the trigger blade carrier 15. On the other hand, a second pressure element 54, here designed pin-like, is arranged in the upper blind bore 51 of the right pendulum 35, as seen in the direction of firing, for contact against the upper part 47 of the trigger blade carrier 15, and a second compression spring 53 is arranged in the lower blind bore 52 of the right pendulum 35, as seen in the direction of firing, for contact against the upper part 47 of trigger blade carrier 15. The two pressure elements 54 are designed in the form of a cushion, for example, from rubber or another elastically compliant material. The impact forces acting between the pendulums 34 and 35 and trigger 14 can be damped by the cushion-like pressure elements 54. The pendulums 34 and 35 are forced against the upper part 47 of the trigger blade carrier 15 through the two compression springs 53 via the cushion-like pressure elements 54.

Due to the implementation and arrangement of the two pendulums 34 and 35, described above, these act as inertial masses and execute a pivoting movement about transverse axis 33 during impacts on trigger housing 12. Because of the different arrangement of the compression springs 53 and pressure elements 54 between the two pendulums 34 and 35 and trigger 14, these act as a multidirectional drop or impact safety whose method of function is explained below with reference to FIGS. 8 to 11.

Figure 8:
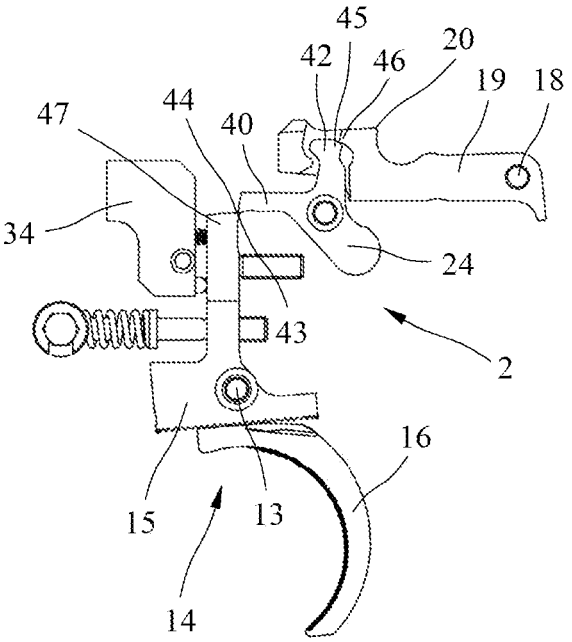
FIG. 8 shows the trigger mechanism shown in FIG. 3 in a cocked position.

The trigger mechanism 2 is shown in FIG. 8 in a cocked position. The rocker-like transfer element 24 lies with its front first stop 43 against the first counter stop 44 on the upper end of the upwardly extending part 47 of trigger blade carrier 15. In this position of the rocker-like transfer element 24, the rear second stop 45 of the rocker-like transfer element 24 engages beneath the second counter stop 46 on sear 19 so that sear 19 is held in the upper holding position. In this upper holding position the firing pin nut 11 shown in FIGS. 1 and 2 is held by sear stop 20. The two pendulums 34 and 35 are found in an undeflected initial position and are forced via compression springs 53 with their pressure elements 54 against the trigger blade carrier 15 of trigger 14 above the transverse pin 13 serving as pivot for trigger 14.

Figure 9:
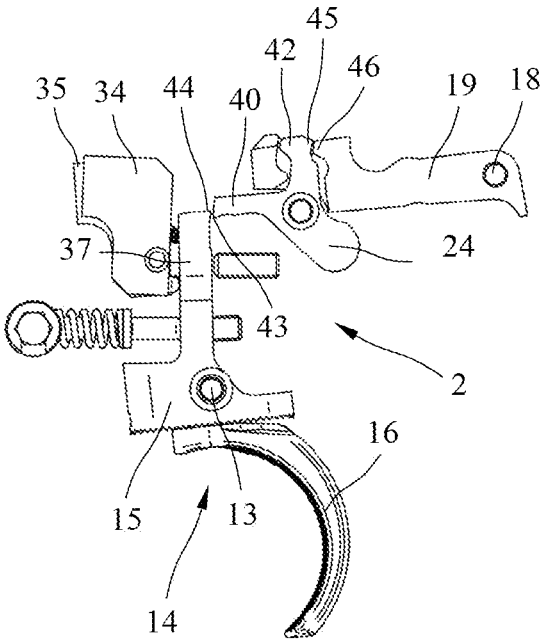
FIG. 9 shows the trigger mechanism shown in FIG. 3 in a half-cocked position.

The trigger mechanism 2 is shown in FIG. 9 with half-cocked trigger 14. By retracting the trigger latch 16 the first counter stop 44 on the upper end of the trigger blade carrier 15 releases the front first stop 43 on transfer element 24 so that the transfer element 24 can rotate counterclockwise and the front first arm 40 can be moved downward. The second stop 45 on the second arm 42 of transfer element 24 then disengages from the second counter stop 46 on sear 19, so that the sear 19 can be rotated into the lower half-cocked position to release the firing pin 8 acted upon by firing pin spring 9. The two pendulums 34 and 35 are moved in opposite directions by movement of the upward extending part 47 of trigger blade carrier 15.

Figure 10:
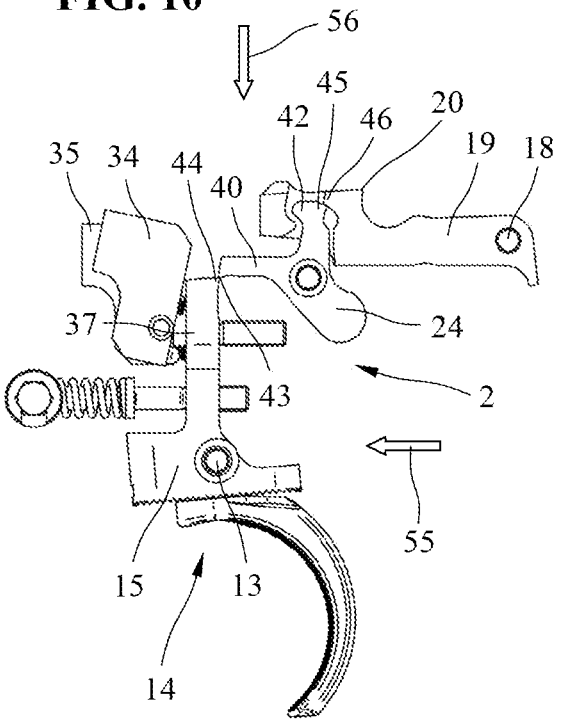
FIG. 10 shows the trigger mechanism shown in FIG. 3 in a cocked position and during impacts from below and above.

If the trigger mechanism 2 in the cocked position as shown in FIG. 10 is subjected to an impact in the direction of arrow 55, caused, for example, by falling or impact on the stock of the repeating weapon or an impact from above in the direction of arrow 56, i.e., an impact occurs on the repeating weapon from the rear or above, the two pendulums 34 and 35 deflect clockwise, in which case the right pendulum 35, as viewed in the direction of firing presses with its pressure element 54 against the upper part 47 of the trigger blade carrier 15 and holds trigger 13 in its initial position.

Figure 11:
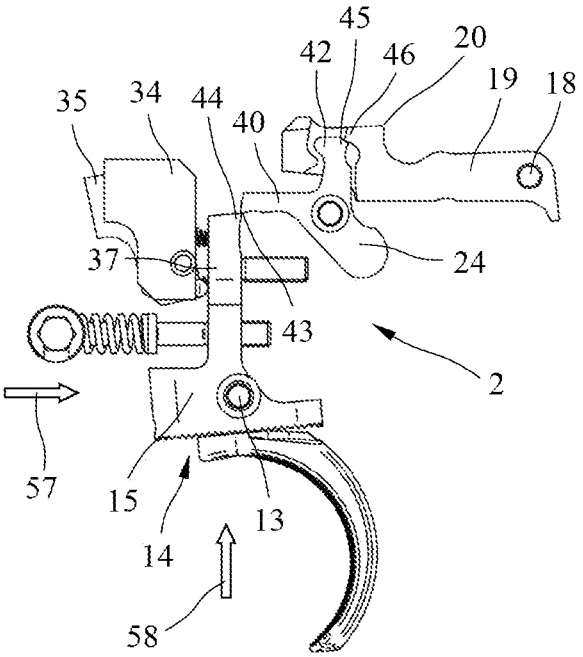
FIG. 11 shows the trigger mechanism shown in FIG. 3 in a cocked position and during impacts from the front and from below.

If, on the other hand, an impact acts on the trigger mechanism 2 in the cocked position, as shown in FIG. 11 in the direction of both arrows 57 and 58, i.e., an impact occurs from below or from the front, the two pendulums 34 and 35 deflect counterclockwise, the right pendulum viewed in the direction of firing deflects, in which case the left pendulum 34 viewed in the direction of firing presses with its pressure element 54 against the upper part 47 of the trigger blade carrier 15 and holds the trigger 13 in its initial position. A force is therefore exerted on the trigger 13 via the two pendulums 34 and 35 during impacts in all directions, which forces the trigger 13 into its initial position.

Figure 12:
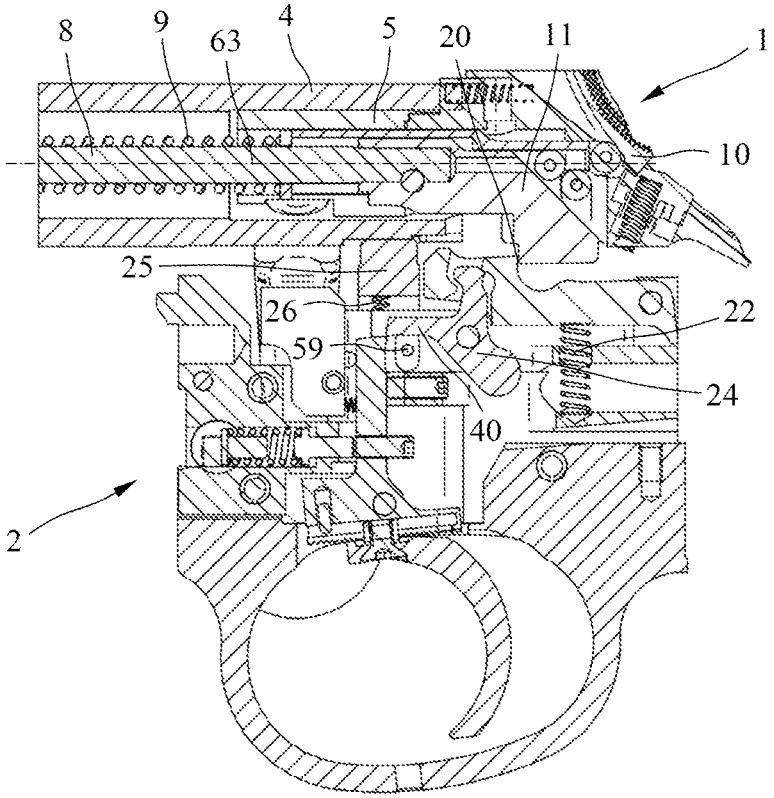
FIG. 12 shows a sectional view of the trigger mechanism in a cocked position with a bolt in the locked position.
Figure 13:
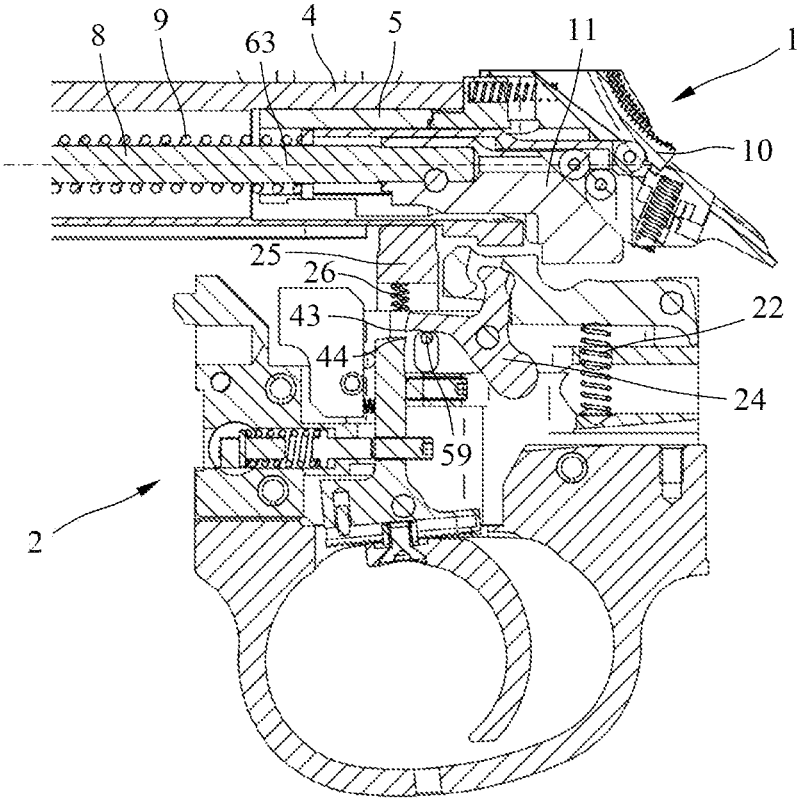
FIG. 13 shows a sectional view of the trigger mechanism with a bolt in the opened position and FIG. 14 shows a sectional view along line A-A of FIG. 1.
Figure 14:
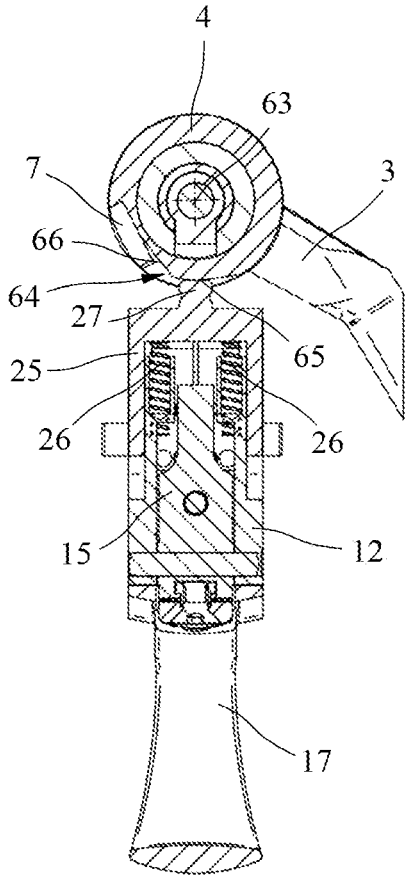

In addition to the drop or impact safety just described, a safety, further depicted in FIGS. 12 to 14, is also attainable via the trigger mechanism 2 to prevent undesired discharge when bolt 1 is unlocked. For this purpose, the breech catch element 25, arranged to move on the top of breech housing 12 transverse to bolt 1, has a blocking element 59, shown in FIGS. 12 and 13, here designed pin-like, which is inserted into two transverse bores 60, shown in FIG. 3 in the two side walls of the fork-like breech catch element 25, and cooperates with the forward protruding arm 40 of the rocker-like transfer element 24 to block or release trigger 14. The transfer element 24 contains a semicircular recess 61 in one of the two side walls, into which the rounded first end of the lever, pivotable about pivot 31, engages. The other rounded second end of lever 30 engages in a semicircular recess 62 on control slide 29.

As shown in FIG. 14, a control cam 64 is provided on the bolt body 4 of bolt 1 rotatable by means of bolt handle 3 about a longitudinal axis 63 between a locked position and a unlocked position and designed as a radial groove on the outside of bolt body 4 to move the breech catch element 25 from a lowered off-safe position into a raised safe position when rotation of bolt body 4, which is caused by the raising of bolt handle 3, occurs into the unlocked position. The control cam 64 has a first control surface 65, against which the upper pin 27 of the breech catch element 25, forced upward by the compression springs 26, comes into contact in a locked position of the bolt body 4 and through which the breech catch element 25 is forced into the off-safe position. The control cam 64 also has a second control surface 66 following the first control surface 65 in the peripheral direction of bolt body 4 and recessed relative thereto, against which the upper pin 27 of the breech catch element 25 forced upward by compression springs 26 comes into contact when bolt body 4 is unlocked and through which the breech catch element 25 reaches the raised safe position.

In the locked position of bolt 1 shown in FIG. 14, the breech catch element 25, forced upward by the two compression springs 26, lies with its upper pin 27 against the first control surface 65 and is pressed downwardly by the latter into the off-safe position shown in FIG. 12. In the off-safe position, the pin-like blocking element 59 is spaced from the bottom of the forward protruding arm 40 of the rocker-like transfer element 24, so that the rocker-like transfer element 24 can be rotated counterclockwise during actuation of trigger 14 and the firing pin nut 11 arranged on the end of the firing pin 8 can be released for half-cocking of the firing pin 8 via the sear stop 20.

If, on the other hand, the bolt handle 3 in the locked position shown in FIG. 14 is raised to unlock bolt 1, and bolt body 4 is therefore rotated counterclockwise, as seen in the direction of firing, pin 27 on the top of the breech catch element 25 contacts the second control surface 66 of control cam 64 offset inward relative to the first control surface 65 so that the breech catch element 25 can be moved upward into the raised safe position under the action of springs 26.

In the completely unlocked position of bolt 1, pin 27 enters the groove 7 of bolt body 4 running in the longitudinal direction, so that the bolt 1 can be pulled rearward for opening of the chamber breech. The groove 7 has a contact surface 67, shown in FIG. 1, on its front to stop the pin 27 of the breech catch element 25. This can prevent the bolt 1 from being completely pulled out of the chamber sleeve during repeating. For disassembly of bolt 1 the breech catch element 25 can be moved by the control slide 29 via lever 30 into a lower disassembly position.

LIST OF REFERENCE NUMBERS

1 Bolt
2 Trigger mechanism
3 Bolt handle
4 Bolt body
5 Small breech
6 Locking lug
7 Guide groove
8 Firing pin
9 Firing pin spring
10 Cocking slide
11 Firing pin nut
12 Trigger housing
13 First transverse pin
14 Trigger
15 Trigger blade carrier
16 Trigger latch
17 Trigger guard
18 Second transverse pin

19 Sear
20 Sear stop
21 Stop edge
22 Spring
23 Third transverse pin
24 Transfer element
25 Breech catch element
26 Compression spring
27 Pin
28 Guide groove
29 Control slide
30 Lever
31 Pivot
32 Recess
33 Transverse axis
34 First pendulum
35 Second pendulum
36 Trigger spring
37 Pressure pin
38 Spring pin
39 Control element
40 First arm
41 Recess
42 Second arm
43 First stop
44 First counter stop
45 Second stop
46 Second counter stop
47 Upper part of trigger blade carrier
48 Transverse pin
49 Transverse bore
50 Rear end surface
51 Upper blind bore
52 Lower blind bore
53 Compression spring
54 Pressure element
55 Arrow
56 Arrow
57 Arrow
58 Arrow
59 Blocking element
60 Transverse bore
61 Recess
62 Recess
63 Longitudinal axis
64 Control cam
65 First control surface
66 Second control surface
67 Stop surface

The invention claimed is:

1. A trigger mechanism of a firearm with a trigger movable between an initial position and a discharge position, a sear movable between a holding position and a half-cocked position, and a transfer element movable by actuation of the trigger between a holding position to hold the sear in the cocked position and a release position to move the sear into the half-cocked position, wherein a safety device is assigned to the trigger with two pendulums pivotable about a transverse axis and deflectable by impacts, wherein the two pendulums are connected to the trigger in such a way that the trigger is forced into the initial position by at least one of the two pendulums during a deflection of the two pendulums caused by impact.

2. The trigger mechanism according to claim 1, wherein the two pendulums are arranged in a trigger housing to be pivotable about the transverse axis and are designed as eccentrically mounted inertial bodies, whose center of gravity is offset upward relative to the transverse axis and forward, as seen in a direction of firing.

3. The trigger mechanism according to claim 1, wherein the two pendulums are each mounted to be pivotable about the transverse axis via a transverse bore and a transverse pin.

4. The trigger mechanism according to claim 1, wherein one of the two pendulums contains a first pressure element offset in a first direction relative to the transverse axis on a rear surface, viewed in a direction of firing for contact against the trigger, and a first spring to force the first pressure element against the trigger, and the other of the two pendulums contains on a rear surface, viewed in the direction of firing, a second pressure element offset in a second direction opposite the first direction relative to the transverse axis, and a second spring to force the second pressure element against the trigger.

5. The trigger mechanism according to claim 4, wherein each of the two pendulums contains on the respective rear end surface an upper blind bore arranged above the transverse axis and a lower blind bore arranged beneath the transverse axis, in each of which a spring and a pressure element are arranged.

6. The trigger mechanism according to claim 4, wherein the first and second springs and the first and second pressure elements lie against an upwardly projecting part of a trigger blade carrier of the trigger rotatable about a transverse pin.

7. The trigger mechanism according to claim 4, wherein the first and second pressure elements include rubber or another elastic material.

8. The trigger mechanism according to claim 1, wherein the transfer element is designed in the form of a rotatable rocker with a first arm cooperating with the trigger and a second arm cooperating with the sear.

9. The trigger mechanism according to claim 8, wherein a first stop is arranged on the first arm of the transfer element to engage with a first counter stop on the trigger, and a second stop is arranged on the second arm of the transfer element to engage with a second counter stop on the sear.

* * * * *